US007114224B2

(12) United States Patent
Kondo et al.

(10) Patent No.: US 7,114,224 B2
(45) Date of Patent: Oct. 3, 2006

(54) SLIDE FASTENER

(75) Inventors: Naoki Kondo, Toyama-ken (JP); Yoneo Yoshida, Toyama-ken (JP); Yoshiyuki Toishi, Toyama-ken (JP); Hideji Maeda, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/778,992

(22) Filed: Feb. 13, 2004

(65) Prior Publication Data

US 2004/0163220 A1 Aug. 26, 2004

(30) Foreign Application Priority Data

Feb. 25, 2003 (JP) ..... 2003-047658

(51) Int. Cl.
*A44B 19/36* (2006.01)

(52) U.S. Cl. ..... 24/436

(58) Field of Classification Search ..... 24/387, 24/397, 398, 403, 433
See application file for complete search history.

(56) References Cited

U.S. PATENT DOCUMENTS 3,862,474 A * 1/1975 Ebata ..... 24/436
3,864,792 A 2/1975 Takahashi et al. ..... 24/436
3,964,137 A * 6/1976 Kihara ..... 24/401
4,752,992 A * 6/1988 Kondo et al. ..... 24/436
6,427,295 B1 * 8/2002 Matsumoto et al. ..... 24/403
6,742,226 B1 * 6/2004 Matsuda et al. ..... 24/436
2002/0121007 A1 9/2002 Matsumoto et al. ..... 24/403

FOREIGN PATENT DOCUMENTS

| | | |
|---|---|---|
| EP | 0 288 953 | 11/1988 |
| JP | 48-37421 | 11/1973 |
| JP | 49-36975 | 10/1974 |
| JP | 62-148116 | 9/1987 |
| JP | 5-31932 | 8/1993 |

* cited by examiner

*Primary Examiner*—Robert J. Sandy
*Assistant Examiner*—Ruth C. Rodriguez
(74) *Attorney, Agent, or Firm*—Everest Intellectual Property Law Group; Michael S. Leonard

(57) ABSTRACT

A weld portion produced by heat welding and a non-weld portion which does not undergo heat welding are formed on a contact face between an inside face of a stopper portion made of synthetic resin and a surface of a fastener tape. Preferably, a bottom end face of a rear side of the stopper portion is made substantially flush with a rear surface of the fastener tape by heating with pressure. Consequently, embrittlement of the stopper portion is prevented and its fixing strength is secured, thereby eliminating itchy feeling and feeling of discomfort originating from a configuration of the upper stopper portion.

10 Claims, 5 Drawing Sheets

SLIDE FASTENER

BACKGROUND OF THE INVENTION

1. Field of the Invention

The present invention relates to a slide fastener in which an upper stopper material having a U-shaped section and made of thermal plastic synthetic resin is attached to a stopper portion of a fastener tape such that the upper stopper material is located adjacent an end portion of the fastener elements mounted along a side edge of the fastener tape by fusing with ultrasonic heating, high-frequency heating or heating with a heater under a pressure.

2. Description of the Related Art

Conventionally, an upper stopper device is attached by welding thermal plastic synthetic resin and generally, a film-like or monofilament-like material is attached to a fastener tape or the top surface of the fastener tape. As for a upper stopper device of a slide fastener disclosed in, for example, Japanese Patent Application Publication No. 48-37421 (patent document 1), mono-filament of thermal plastic synthetic resin, for example, polyester resin or polyamide resin is, cut out into a predetermined length and bent into a U shape and then press-fitted to an inverted portion or a leg portion of coil-like fastener elements to be molded by welding and fixed thereto at the same time. In an upper stopper device of a slide fastener disclosed in, for example, Japanese Patent Application Publication No. 49-36975 (patent document 2), on a bead formed on a side edge of a fastener tape is mounted a coil-like fastener element of the same size as the bead and then, a short filament material is placed on this fastener element, bead and the top face of part of the fastener tape and these are fused together and hardened so as to form and settle a stopper portion.

However, because in these well-known slide fasteners, their upper stopper portions are molded on only the top face of the fastener tape by welding, the mounting strength thereof to the fastener tape is weak. Thus, the stopper portion on which the largest impact force is applied when a slider flange strikes is likely to be separated from the fastener tape easily, so that this kind of the stopper portion cannot bear a long-term usage. The top face of each of the slide fastener and its components mentioned in this specification refers to an outside surface in an attachment component of the slide fastener while its bottom face refers to an inside surface.

Conventionally, to solve such a problem, for example, Japanese Utility Model Application Laid-Open No. 62-148116 (patent document 3) and Japanese Utility Model Application Publication No. 5-31932 (patent document 4) have proposed slide fasteners in which each upper stopper is never separated, the upper stopper device being composed of synthetic resin having a large welding strength. According to these publications, the upper stopper device sandwiches upper and lower faces of a side edge portion of a fastener tape and respective ends of the upper stopper on the side of a tape main body on top and bottom surfaces thereof are joined together in a bridge-like configuration through a gap or an opening made among composition yarns of woven or knitted fabric of the fastener tape, so that they are integrally welded. According to the patent document 3, at this time, an entire inner peripheral face of the stopper device is welded with a side edge portion of the tape at the same time, while according to the patent document 4, the inner peripheral face of the upper stopper is not welded with a tape except an end portion of the upper stopper near the inside of the tape.

As a result, the document 3 proposes a stopper portion which secures a strong fixing condition having a large weld portion area capable of enduring a violent strike by a slider sufficiently and has an extremely high reliability capable of bearing a hard contact by a strong sliding force of the slider. According to the document 4, only the end portion of the upper stopper on the side of the tape main body is welded strongly and the inner peripheral face on the side of the tape main body except the end portion of the upper stopper is not welded. Thus, when the slider strikes, the upper stopper swings around the end portion, so that a kind of buffering effect is generated, thereby protecting the upper stopper from damage.

Because the upper stopper of each of the slide fasteners disclosed in the patent documents 3 and 4 is composed of a flat smooth surface, a large contact area with an inside face of the slider is generated. Consequently, when a sliding operation for opening the slide fastener is started, its sliding resistance is large and thus, there exists a feeling of heaviness. Further, the flat configuration of the upper stopper not only increases the sliding resistance of the slider but also largely affects a separation resistance due to catching with the slider at the time of start of the sliding.

Generally, the closing of the slide fastener by the sliding operation of the slider is achieved by a contact between opposing end faces of the right and left upper stoppers and joint column portions of the slider, and a contact between the end portions on the tape main body of the upper stopper and front faces of slider flange portions when the slider is slid. Because a quite large striking force due to the sliding operation of the slider acts upon the upper stopper when the upper stopper contacts the slider, part of the slider may sometimes catch the upper stopper. For the reason, the above-described faults occur.

Generally, when the slide fastener is mounted on object clothes, a bottom face of the fastener is directed directly to the human body, so that it makes a direct contact with the skin depending on the case. Thus, because the upper stopper is small, if it projects from the bottom face of the fastener tape, it gives itchy feeling to the skin. When the slider is started, the upper stopper portions of the slide fastener are nipped with the fingers while a pull tag is nipped with the finger of the other hand. At this time, some people may sense a feeling of discomfort because hardness feeling of the upper stopper is transmitted to the fingers.

The itchy feeling and feeling of hardness are sensed particularly because a portion making contact with the skin on the edge on the side of the tape main body of the upper stopper projects outward from the surface of the fastener tape main body. In the patent documents 1 to 4, it is understood that the edge on the side of the tape main body of any upper stopper projects outward from the surface of the fastener tape main body.

Further, because the conventional stopper portion is integrated by fusing with the fastener tape through its entire contact faces, the amount of heat necessary for fusing entirely needs to be increased. As a result, not only the stopper portion but also the fastener tape are supplied with heat more than necessary, so that embrittlement due to over-heating occurs. Consequently, the stopper portion likely cracks and drops out and further, the mounting portion of the stopper is likely to be strict-structured.

The present invention has been achieved to solve such conventional problems and a specific object of the present invention is to provide a upper stopper of a slide fastener, particularly a U-shaped upper stopper made of synthetic resin mono-filament material, which is formed and fixed by welding on a side edge of the fastener tape by heating with a pressure, the upper stopper being not made embrittle or hardened by the welding, so that sliding resistance at the time of sliding of the slider by the upper stopper is reduced and itchy feeling and feeling of discomfort based on the configuration of the upper stopper are eliminated.

SUMMARY OF THE INVENTION

Part of the above-described object is achieved by the basic structure of the present invention, namely, a slide fastener having a stopper portion composed of thermoplastic resin for restricting a sliding of a slider, the stopper portion being located at an end portion of a fastener element row attached to a side edge of a fastener tape such that the same stopper portion is heat-welded so as to sandwich the side edge portion of the fastener tape from front and rear faces thereof, wherein a contact face between an inside face of the stopper portion and the surface of the fastener tape has a weld portion produced by heat welding and a non-weld portion which does not undergo heat welding.

To form the weld portion and the non-weld portion, a portion which does not make a direct contact with the fastener tape is formed locally in a pressing face of an ultrasonic horn or a high-frequency electrode for the stopper portion or the stopper portion placing face of an opposing anvil or electrode or in case of heating with a heater, its heating pressure surface.

Because the weld portion and the non-weld portion are formed on a contact face between the stopper portion and the fastener tape as described above, a sufficient attachment strength between the stopper portion and the fastener tape is secured and as compared to a case of welding entirely, the stopper portion and fastener tape are not heated more than necessary. Consequently, a stopper portion which fits well to the fastener tape without any embrittlement due to high temperatures and unnecessary hardening can be formed. Meanwhile, the ratio between and locations of the weld portion and the non-weld portion can be determined easily by selecting appropriately the ratio in area between and location of a pressing face of an ultrasonic horn or a high-frequency electrode for the stopper portion and a placing surface of an opposing anvil or electrode or in case of heating with a heater, the ratio in area between and location of a portion making no contact with the fastener tape of its heating pressure face and a portion making contact. This selection enables adjustment in level of embrittlement and attachment strength.

According to the present invention, preferably, a face of an end portion on the side of a tape main body of the stopper portion is at least flush with or located at a position slightly retreated from a face of the tape main body. Usually, the slide fastener is often disposed such that its rear side is near the human body. Now if an end portion, which is a tiny member, of the stopper device on a tape side projects from the rear surface of the fastener tape, its tip makes a contact with the skin so that itchy feeling or feeling of discomfort is felt. If as proposed by the present invention, the end portion of the stopper device on the side of the tape main body, specifically, the end portion of its rear face is made flush with or on the same level as the rear surface of the fastener tape or located at a position retreated from the rear surface of the fastener tape, the itchy feeling or feeling of discomfort is eliminated. Such a structure can be gained by providing the tape placing face of the ultrasonic horn or high-frequency electrode on the same level as the stopper device placing face of the anvil or electrode.

Preferably, the weld portion has a first weld portion at an end portion on the side of the tape main body (inside) of the stopper portion and a second weld portion existing at a place except the end portion. Further, the first weld portion and the second weld portion can be disposed separately or the first weld portion and the second weld portion can be disposed continuously.

As the weld portion in the stopper portion, the first weld portion is formed at the end portion on the side of the tape main body (inside) and the second weld portion is formed at other portions except the end portion, such that they are continuous or discontinuous. Alternatively, another second weld portion is formed discontinuously. By forming the weld portion and the non-weld portion in various styles, the attachment strength of the stopper portion to the fastener tape can be controlled and particularly, because the weld portion is always formed at the end portion on the side of the tape main body (inside), there is no fear that the same end portion may be separated.

According to the present invention, if a core portion having an expanded section is provided on the side edge (element attaching portion) of the fastener tape, preferably, the second weld portion is formed on opposing faces between the stopper portion and the core portion. That is, locating the end portion of the stopper portion on the side of the tape main body (inside) in the core portion is avoided and the same end portion is always directly welded with the fastener tape. Consequently, the end portion on the side of the tape main body of the stopper portion is fixed to the fastener tape securely and never separated. If the aforementioned end portion is welded with the core portion, the stopper portion may be floated on the fastener tape so that the stop position of the slider often may not be determined.

The core portion has a core thread disposed on a top face of the fastener tape while the second weld portion is formed on opposing faces between the stopper portion and the core thread. There are a case in which an opposing face between the stopper portion and the fastener tape is formed as the non-weld portion, and a case in which the second weld portion is formed on an entire opposing face between the stopper portion and the fastener tape. Further, in other cases, the second weld portion is formed on an opposing face between the stopper portion and the core thread and an opposing face between the stopper portion and the fastener tape.

Moreover, preferably, a side edge of the fastener tape, that is, the element attaching portion has an element fixing yarn while the second weld portion is formed on opposing faces between the stopper portion and the element fixing yarn. As this element fixing yarn, a sewing yarn for sewing the elements to the fastener tape is available and further, warp yarns for fixing each element to the fastener tape when a continuous fastener element row formed of mono-filament is woven or knitted at the same time as weaving or knitting of the fastener tape is also available. If the stopper portion is welded with and fixed to such an element fixing yarn, the fixing yarn itself is integrated with the fastener tape, thereby not only the attachment strength of the stopper portion being improved but also the stability in the attachment configuration of the stopper portion being secured.

DESCRIPTION OF THE PREFERRED EMBODIMENTS

Hereinafter, preferred embodiments of the present invention will be described specifically with reference to the accompanying drawings.

Figure 1:
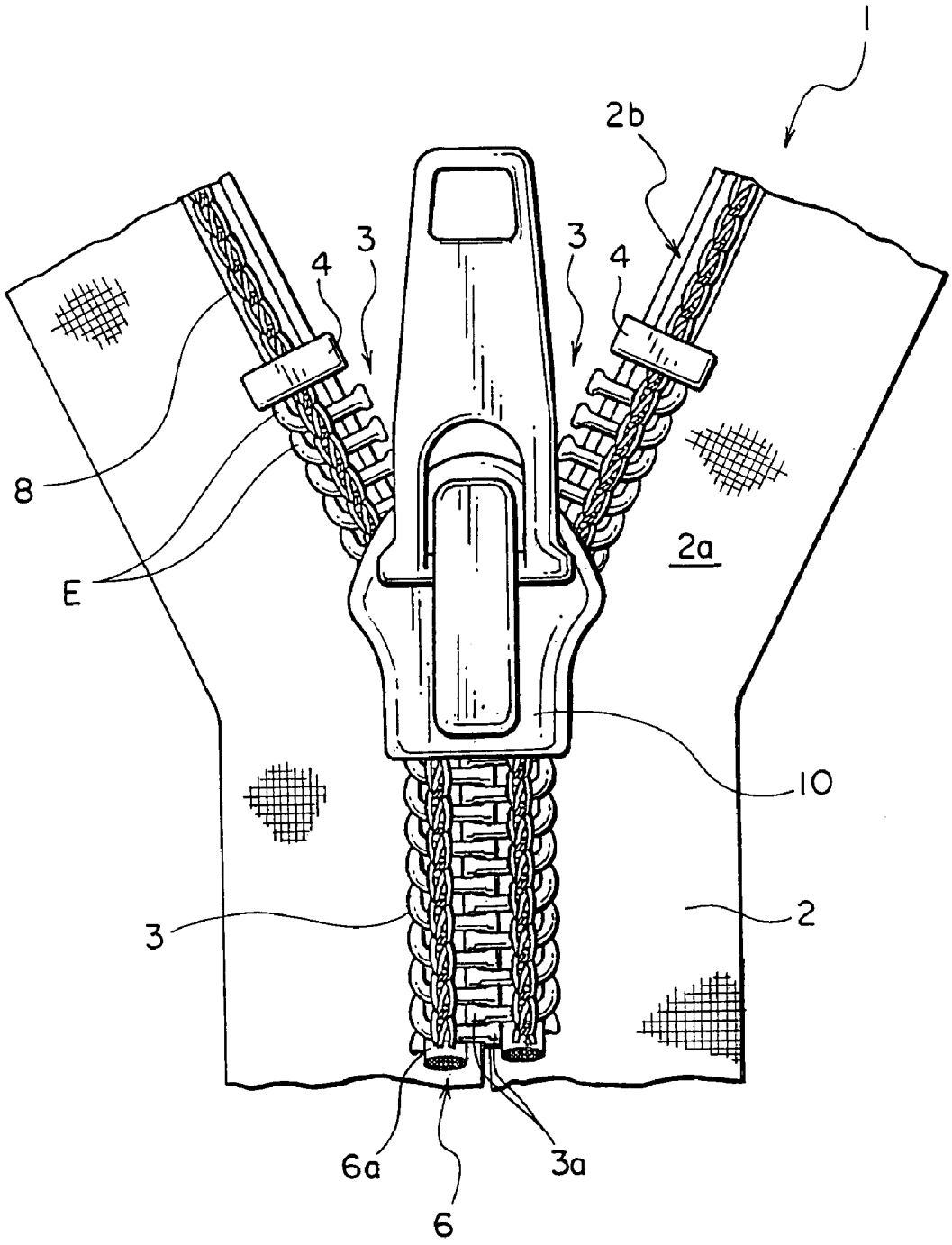
FIG. 1 is a plan view of major portions showing an example of a slide fastener according to the present invention.
Figure 2:
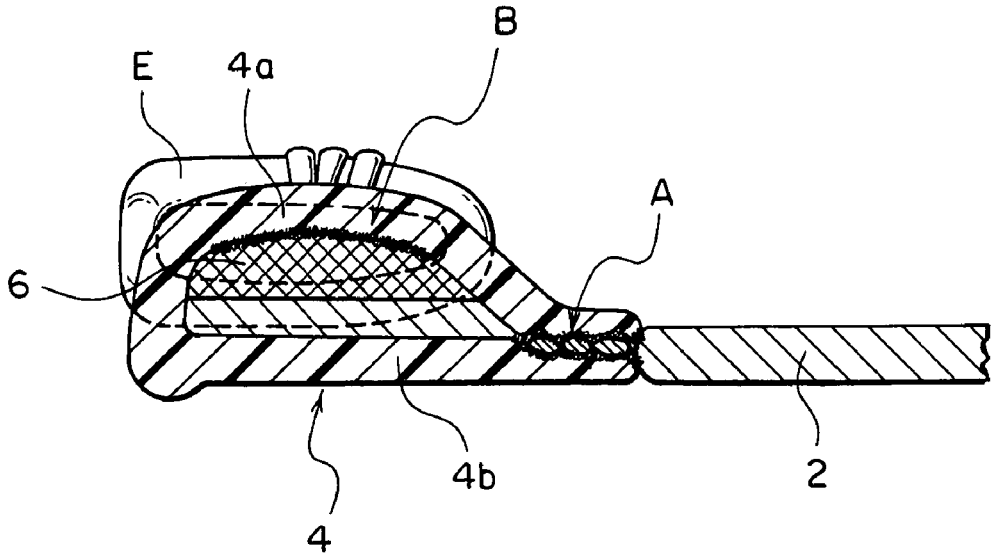
FIG. 2 is a partial sectional view showing an example of the structure of an upper stopper attaching end portion of a slide fastener according to a first embodiment of the present invention.

FIG. 1 shows an upper stopper side end portion of a slide fastener according to the present invention. FIG. 2 is a sectional view showing an upper stopper mounting condition of a slide fastener according to a typical embodiment of the present invention.

As shown in FIG. 1, a continuous fastener element row 3 is attached on a side edge of a fastener tape 2 and an upper stopper portion 4 of the slide fastener is mounted on a top end portion on the closing side of each of right and left fastener stringers while a lower stopper portion (not shown) is mounted on an end portion on the opening side. Although in a slide fastener 1 provided with two or more sliders 10, the same stopper portion as the upper stopper portion 4 is attached to each of both the upper and lower ends, all stopper portions will be referred to as upper stopper portion below.

As for the upper stopper portion 4, like the upper stopper portions mentioned in the above-described patent documents 3 and 4, an upper stopper material (not shown), which is composed of thermoplastic synthetic resin mono-filament or an irregular linear member of the same material and bent into a U shape in its section, is molded and fixed on a side edge of the fastener tape 2 having the fastener elements 3 attached thereon by fusing with ultrasonic heating, high-frequency heating or heating directly with a heater (not shown) under a pressure from both the front and rear sides of the fastener tape 2 so as to form the upper stopper portion 4.

The above-mentioned upper stopper material is produced by cutting flat monofilament composed of, for example, polyester resin or polyamide resin into a predetermined length and bent into a U-shape in terms of section. The corner of this mono filament is formed in a round shape. Alternatively, it is permissible to cut out an irregular linear material having a U-shaped section composed of the same material under a predetermined width.

To form the upper stopper portion 4 integrally with the fastener tape 2 using the upper stopper material, the upper stopper material formed in a U-shape is placed adjacent an element on an end of the fastener element row 3 mounted on a side edge of the fastener tape 2 or disposed such that front ends of upper and lower leg portions of the upper stopper material projects to the side of a main body 2*a* of the fastener tape 2 from a connecting portion of the fastener element 3 while a core portion 6 existing on a side edge portion 2*b* of the fastener tape 2 is sandwiched together with a cutout end portion of the element by the upper and lower leg portions. Then, this upper stopper material is heated and pressurized so as to form the upper stopper portion 4 at a predetermined position integrally.

As for the disposing, in case of using ultrasonic treatment, a pressing face of its horn is placed to oppose a rear face of the tape while a front side of the tape is placed on a placing surface of an anvil. In case of high-frequency treatment, any one of the front and rear surfaces of the tape is placed to oppose an electrode while an opposite side of the fastener tape 2 is placed on the other electrode face. In case of heating with a heater, a rear side of the fastener tape 2 is placed on its lower heating surface while its upper heating surface is placed to oppose the front side of the same tape 2. Then, an upper leg portion 4*a* of the upper stopper portion 4 disposed in this way is heated together with a lower leg portion 4*b* under a pressure by the ultrasonic horn, the high-frequency electrode or a heater pressing face disposed up (not shown), so that the upper leg portion and lower leg portion are welded and integrated with the fastener tape 2 and formed into a desired shape at the same time.

In this embodiment also, like the patent documents 1 and 2, pressing on the end portion on the side of the tape main body 2*a* of the upper stopper portion 4 is intensified so as to allow part of molten resin to penetrate into a gap generated among composition yarns of the fastener tape 2, so that the upper leg portion and lower leg portion are connected together and integrated in a bridge-like fashion as shown in FIG. 2. Therefore, the attachment strength of the upper stopper portion 4 to the fastener tape 2 is secured. A weld portion at an end on the side of the tape main body 2*a* of the upper stopper portion 4 serves as a first weld portion A.

According to the embodiment indicated in the same figure, a core thread 6*a* is placed along the coil-like fastener element row 3 and as shown in FIG. 2, each element of the fastener element row 3 is fixed on the fastener tape 2 by sewing with a sewing yarn 8 together with the core thread 6*a*. Then, part of the element E disposed on a top end portion of the fastener tape is cut out and removed, and the upper stopper portion 4 is attached to the fastener tape 2 through the core thread 6*a* by welding so as to contain a lower leg portion of the element E located at the most extreme end. That weld portion serves as a second weld portion B in the present invention.

At this time, the welding is achieved on an inside face of the upper leg portion 4*a* of the upper stopper portion 4 and a portion of the core thread 6*a* apart from an end portion on the side of the tape main body 2*a* such that the portion of the core thread 6*a* opposes the same inside face of the upper leg portion 4*a* of the upper stopper portion 4. Other portion opposing the upper stopper portion of the fastener tape 2 except the end portion on the side of the tape main body 2*a* is not welded. The portion which is not welded serves as the non-weld portion in the present invention. Because the inside face of the upper leg portion 4*a* of the upper stopper portion 4 and the portion of the core thread 6*a* opposing the same inside face are welded, the bent side of the upper stopper portion 4 is not moved easily so as to stop the slider securely. Further, at an end on the side of the tape main body 2*a* of the upper stopper portion 4, a bottom face of the lower leg portion 4*b* disposed on the bottom side is substantially flush with the rear face of the fastener tape 2. As a result, a bottom of a tip end of the lower leg portion 4*b* of the upper stopper portion 4 does not project from the tape surface, thereby eliminating itchy feeling or feeling of discomfort.

Figure 3:
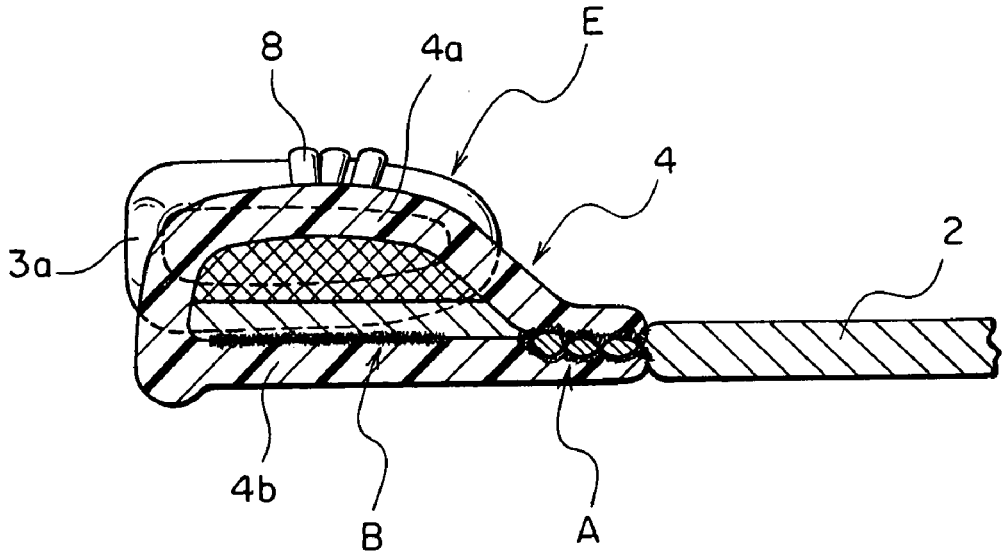
FIG. 3 is a partial sectional view showing a modification of the structure of the aforementioned upper stopper attaching portion.

FIG. 3 shows a modification of the above-described embodiment, which is different from the embodiment shown in FIG. 2 in that the welding between the upper stopper portion 4 and the fastener tape 2 is achieved between the inside face of the lower leg portion 4*b* of the upper stopper portion 4 and an opposing bottom face of the fastener tape 2. Because according to this modification, the welding between the upper stopper portion 4 and the fastener tape 2 is achieved on the upper and lower leg portions 4*a* and 4*b* at the end on the side of the tape main body of the upper stopper portion 4 and the inside face of the lower leg portion 4*b*, the upper stopper portion 4 is fixed on the fastener tape securely, so that it does not deviate on the fastener tape 2 when the slider strikes. Further, like the above embodiment, there is no itchy feeling or feeling of discomfort by the upper stopper portion 4.

Figure 4:
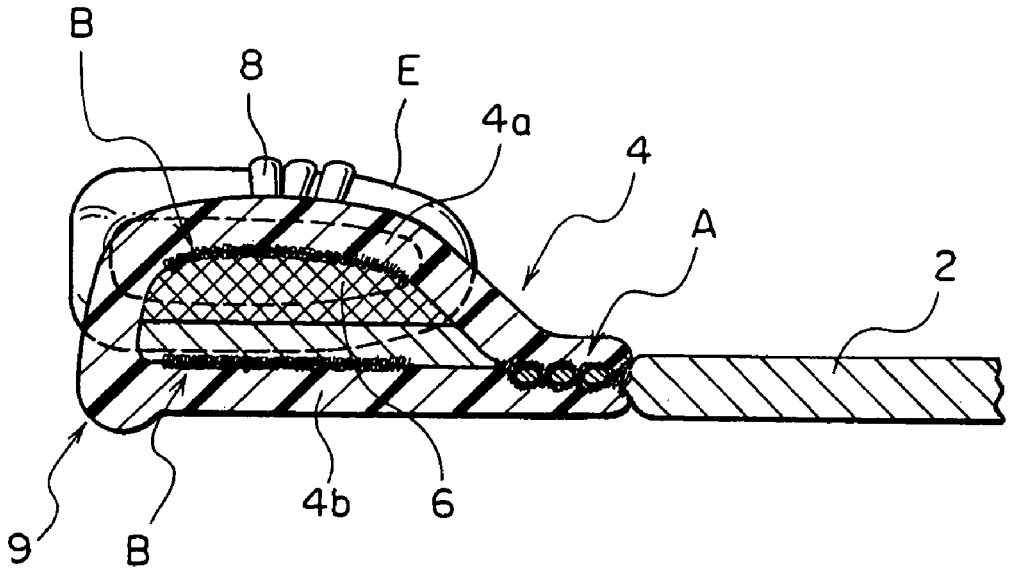
FIG. 4 is a partial sectional view showing another modification.

FIG. 4 shows another modification of the above-described embodiment. According to this modification, the end portion of the upper stopper portion 4 on the side of the tape main body is integrated by welding in a bridge-like fashion with the fastener tape 2 from above and below like the previously described embodiment so as to form a first weld portion A. Additionally, it is fixed to the core thread 6*a* and fastener tape 2 opposing inside faces of the upper and lower leg portions 4*a*, 4*b* of the upper stopper portion 4 by welding so as to form a second weld portion B. Thus, this modification provides the largest weld portion area thereby securing the highest attachment strength of the upper stopper portion 4.

Figure 5:
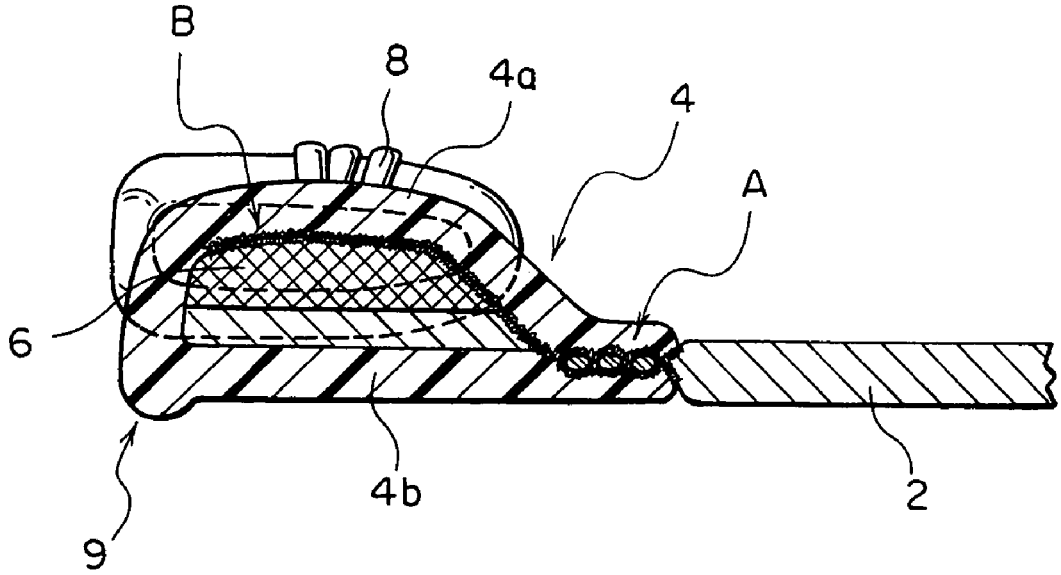
FIG. 5 is a partial sectional view showing still another modification.

FIG. 5 shows a further modification of the modification shown in FIG. 2. That is, in the modification shown in FIG. 2, the weld portion at the end of the tape main body of the upper stopper portion 4 and the weld portion of the upper leg portion 4*a* of the upper stopper portion 4 are separated. This modification is different from the modification shown in FIG. 2 in that the first weld portion A at the end of the tape main body of the upper stopper portion 4 and the second weld portion B of the upper leg portion 4*a* of the upper stopper portion 4 of this modification are formed continuously. Thus, according to this modification, the weld portion area on the tape top face of the upper stopper portion 4 is increased as compared to the modification shown in FIG. 2 and continuous and therefore, a predetermined attachment strength to the upper stopper portion 4 is likely to be gained.

Figure 6:
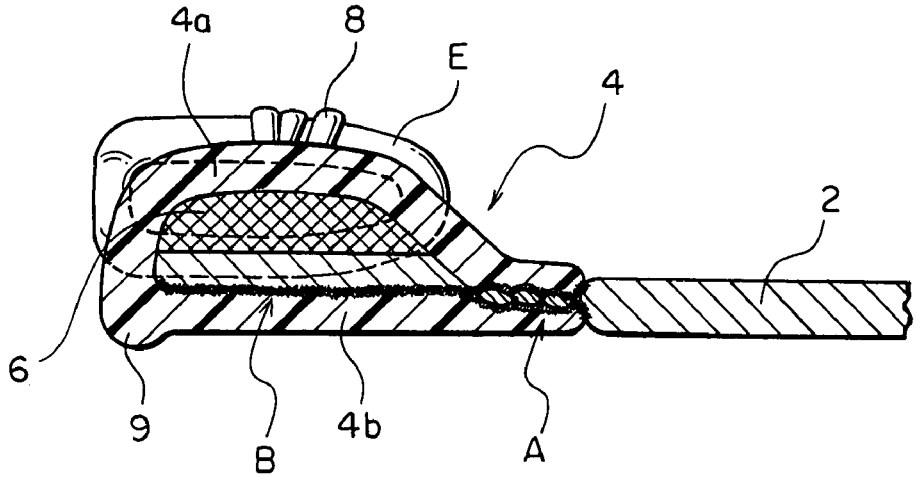
FIG. 6 is a partial sectional view showing still another modification.

FIG. 6 shows a further modification of the modification shown in FIG. 3. That is, in the modification shown in FIG. 3, the weld portion at the end of the tape main body of the upper stopper portion 4 and the weld portion of the lower leg portion 4*b* are separated. This modification is different from the modification shown in FIG. 3 in that the weld portion at the end of the tape main body of the upper stopper portion 4 and the weld portion of the lower leg portion 4*b* of this modification are formed continuously. Therefore, according to this modification, the weld portion area on the tape top face of the upper stopper portion 4 is increased as compared to the modification shown in FIG. 3, so that a predetermined attachment strength is likely to be gained.

Figure 7:
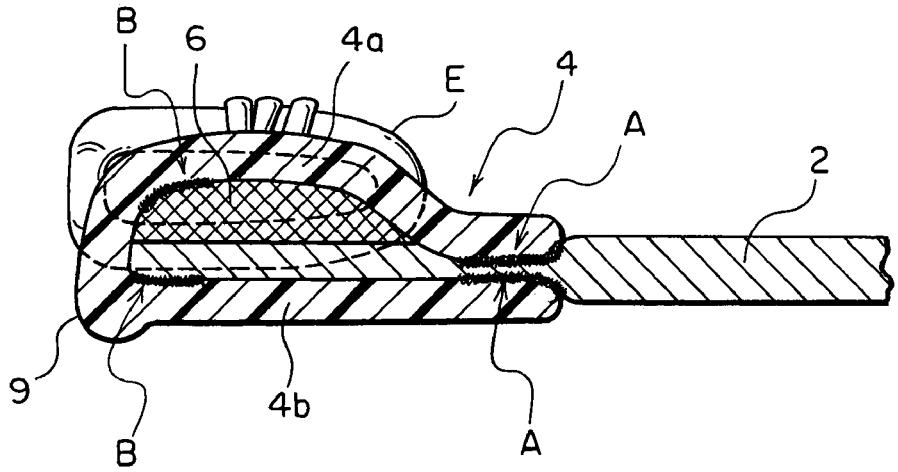
FIG. 7 is a partial sectional view showing an example of the structure of an upper stopper attaching end portion of a slide fastener according to a second embodiment of the present invention.

FIG. 7 shows a second embodiment of the present invention. According to the second embodiment, in the first weld portion A at the end of the tape main body of the upper stopper portion 4, upper and lower faces of the fastener tape are welded together with a gap sandwiched without allowing the weld portion to penetrate into the gap among composition yarns of the fastener tape 2, which is different from the first embodiment. Additionally, the weld portions at the upper and lower leg portions 4*a* and 4*b* of the upper stopper portion 4 are formed as the second weld portion B, independently located at bent portions which are proximal portions of the leg portions 4*a* and 4*b*. Of course, these are separated from the weld portions at the end of the tape main body of the upper stopper portion 4. Thus, the portion weakened by welding is decreased in this embodiment and consequently, although the durability is heightened, the attachment strength of the upper stopper portion 4 drops more or less as compared to the first embodiment. However, it is sufficient enough for actual usage.

Figure 8:
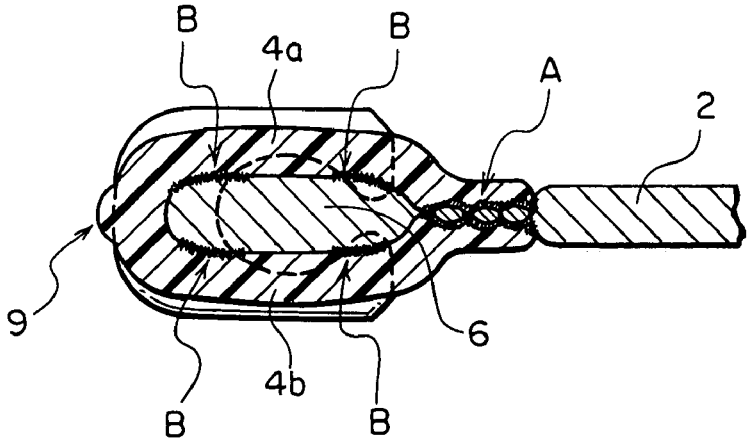
FIG. 8 is a partial sectional view showing an example of the structure of an upper stopper attaching end portion of a slide fastener according to a third embodiment of the present invention.

FIG. 8 shows a third embodiment of the present invention. In the slide fastener 1 of the third embodiment, each fastener element E is mounted independently to an element attaching portion located on a side edge of the fastener tape 2 at a predetermined pitch such that it sandwiches the top and bottom faces of the fastener tape 2 from above and below. This fastener element E is composed of metal or thermoplastic resin material or may be formed integrally with the fastener tape by injection molding. If this fastener element is made of metal, this V-shaped fastener element E having an engagement pawl formed on inside of its each front end alternately is crimped and fixed. To increase the attachment strength, a core portion 6 is formed at the element attaching portion such that it is expanded outwardly from the top and bottom faces of the fastener tape 2.

The material of the upper stopper portion 4 of this embodiment is also composed of a U-shaped piece of thermoplastic resin and has a vertically-symmetrical shape so as to be integrated with a tape portion of the fastener stringer by welding by heating the same material with a pressure from above and below. According to this embodiment also, the end on the side of the tape main body of the upper stopper portion 4 is pressed strongly from above and below, so that part of the weld portion penetrates into gap among tape composition yarns to form a bridge-like weld portion, which is a first weld portion A. On the other hand, plural second weld portions B are produced on inside faces of the upper and lower leg portions 4*a*, 4*b* of the upper stopper portion 4. In this embodiment, those second weld portions B are located on the inside faces of the upper and lower leg portions 4*a* and 4*b* of the upper stopper portion 4, which are four positions located in the vicinity of the end on the side of the tape main body and on bent portions, which are proximal ends of the upper and lower leg portions 4*a* and 4*b*. These weld portions prevent weakening and secure a predetermined attachment strength.

Figure 9:
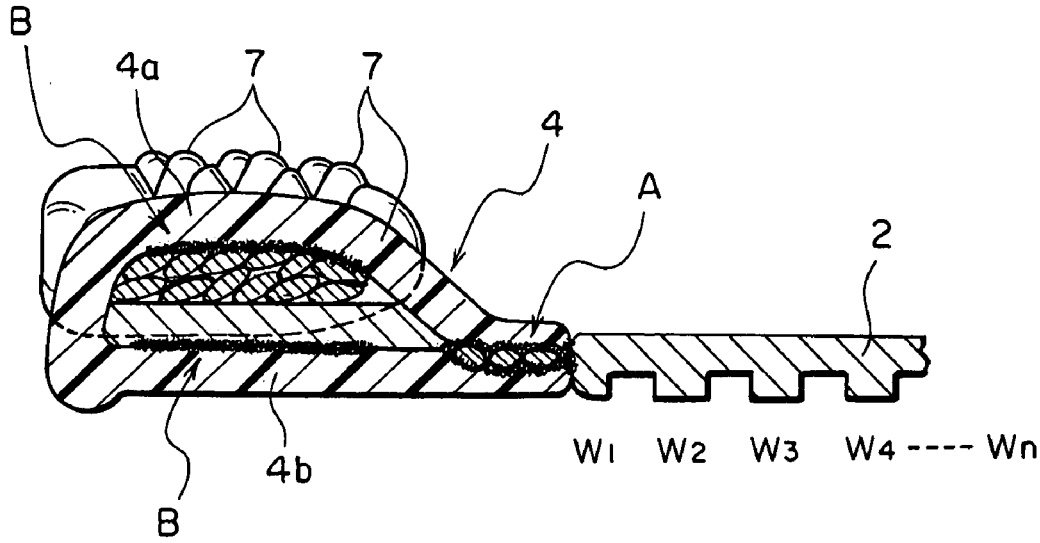
FIG. 9 is a partial sectional view showing an example of the structure of an upper stopper attaching end portion of a slide fastener according to a fourth embodiment of the present invention.

FIG. 9 shows a fourth embodiment of the present invention. The slide fastener 1 of this embodiment is of such a type in which the coil-like fastener element row 3 formed of mono-filament is woven or knitted at the time when the fastener tape 2 is woven or knitted so as to attach the fastener elements E. Usually, in this type of the slide fastener 1, there exists no core thread and instead, warp yarns 7 for fixing the elements run on front and rear surfaces of the fastener element E such that they intersect each other. This indicated example shows a knitted fastener tape 2, in which plural wales W1 to Wn are formed such that they extend linearly in the length direction in parallel on the rear surface of the fastener tape 2.

In this embodiment also, like the first embodiment shown in FIG. 1, an end portion of the fastener element row 3 is cut out and the U-shaped material as the upper stopper portion 4 is pressed against the element attaching portion together with the fastener element E with heating, so that the U-shaped material is integrated with the element attaching portion to form a weld portion. At the end portion on the side of the tape main body of the upper stopper portion 4, like the first embodiment shown in FIG. 1, part of the upper stopper portion 4 is fused and penetrates into gap among composition yarns from above and below, so that the upper and lower leg portions are integrated like a bridge so as to form a first weld portion A. On the inside faces of the upper and lower leg portion 4*a* and 4*b* of the upper stopper portion 4, like the modification shown in FIG. 4, an inside face of the upper leg portion 4*a* is welded with a top face of a fixing warp yarn 7 and an inside face of the lower leg portion 4*b* is welded with a bottom face of the fastener tape 2 so as to form a second weld portion B. Because with such a structure, part of the fixing warp yarns 7 is integrated with the upper stopper portion 4 in addition to the above-mentioned operation and effect, yarn entanglement never occurs thereby intensifying the durability.

Figure 10:
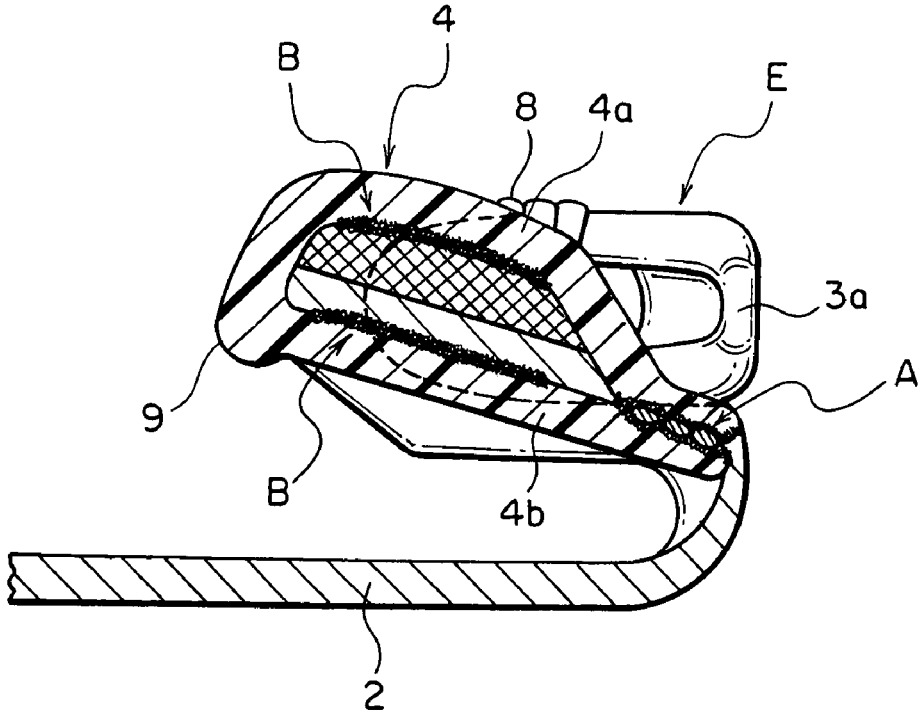
FIG. 10 is a partial sectional view showing an example of the structure of an upper stopper attaching end portion of a slide fastener according to a fifth embodiment of the present invention.

FIG. 10 shows a fifth embodiment of the present invention. This embodiment concerns a hidden type slide fastener in which the coil-like fastener element row 3 is mounted on an element attaching portion on a side edge of the fastener tape 2 as the slide fastener 1 by sewing and then, the fastener tape 2 adjoining the fastener element row 3 is bent by 180° along the length direction, its configuration being set thermally. By this bending and setting of the fastener tape 2, a coupling head 3*a* of the fastener element row 3 is exposed outwardly along its bending line and if this hidden type slide fastener 1 is mounted on object clothes, the fastener element row 3 is disposed on the rear surface of the object clothes, so that when the slide fastener 1 is closed, the fastener element row is invisible from outside thereby hiding the existence of the slider fastener 1.

In this hidden type slide fastener 1 also, the upper stopper portion 4 is placed adjacent a top end of the fastener element row 3 or attached including the element E at the top end like the above-described embodiment. FIG. 10 shows an example of the attachment condition. A core thread 6*a* is inserted through the coil-like fastener element row 3, and this element row 3 is fixed to the element attaching portion of the fastener tape 2 with a sewing yarn 8. Thus, the upper stopper portion 4 is integrated with the rear surface of the fastener tape 2 by welding such that part of each of the surface of the tape, the core thread 6*a* and the sewing yarn is sandwiched.

As for welding of the upper stopper portion 4 and the element attaching portion of the fastener tape 2 according to this embodiment, as shown in FIG. 10, the end portion on the side of the tape main body of the upper stopper portion 4 is deformed by a strong pressure and fused, so that the fused material is allowed to penetrate into a gap generated among the composition yarns in the fastener tape 2 from front and rear to form a bridge-like integrated portion, as the first weld portion A. At the same time, an inside face of the upper leg portion 4*a* is integrated with part of the surface of the core thread 6*a* and the sewing yarn 8 by welding while an inside face of the lower leg portion 4*b* is integrated with part of the rear surface of the fastener tape to form the second weld portion B. This embodiment also secures the largest welding strength like the modification shown in FIG. 4 and enables the upper stopper portion 4 to be attached securely without accompanying embrittlement of the upper stopper portion 4.

According to the respective embodiments, a rib-like protrusion 9, which extends in the width direction of the stopper portion, is provided on a rear surface of the bent end portion which connects the upper and lower leg portions 4*a* and 4*b* of the upper stopper portion 4 shown in FIGS. 1 to 8, 9 and 10. This protrusion 9 is formed by a cavity formed in a heater, die or electrode when the U-shaped stopper material is pressed at the time of welding and molding. When the slide fastener is opened or closed by operating a slider (not shown), the existence of this protrusion 9 increases a striking area of the stopper portion thereby contributing to providing the stopper portion with a secure stop function.

Further, this protrusion 9 may be formed at any position and for example, may be formed at a vertex of the bent portion of the upper stopper portion 4 as shown in FIG. 8. Additionally, although any one of these protrusions 9 is formed in a rib-like configuration, it may be formed in a point-like configuration or multiple ones may be formed or may be formed as an entirely curved expanded section.

As described above, the welding position of the upper stopper portion 4 to the fastener tape 2 in the slide fastener of the present invention can be selected arbitrarily and its weld portion area can be determined arbitrarily considering the attachment (welding) strength if embrittlement of the weld portion can be avoided.

What is claimed is:

1. A slide fastener having a stopper portion composed of thermoplastic resin for restricting a sliding of a slider at an end portion of a fastener element row attached along a side edge of a fastener tape, wherein the stopper portion is an upper stopper portion mounted on a top end portion of each of right and left fastener stringers, and the stopper portion has an upper leg portion, a lower leg portion, and a bent portion which is a proximal portion of the upper and lower leg portions, wherein the stopper portion is fixed to front and rear faces of the fastener tape by fusing with heat so as to sandwich the fastener tape of the fastener tape, wherein a contact face between an inside face of the stopper portion and a surface of the fastener tape has a weld portion which is produced by heat welding and a non-weld portion which does not undergo heat welding, and wherein the weld portion has a first weld portion at the end portion on the side of the tape main body of the stopper portion and a second weld portion existing at a place except the end portion.

2. The slide fastener according to claim 1, wherein a face of an end portion on the side of a tape main body of the stopper portion is at least flush with or located at a position slightly retreated from a face of the tape main body.

3. The slide fastener according to claim 1, wherein the first weld portion and the second weld portion axe disposed separately.

4. The slide fastener according to claim 1, wherein the first weld portion and the second weld portion are disposed continuously.

5. The slide fastener according to claim 1, wherein the second weld portion is discontinuous.

6. The slide fastener according to claim 1, comprising a core portion having an expanded section on the side edge of the fastener tape while the second weld portion is formed on opposing faces between the stopper portion and the core portion.

7. The slide fastener according to claim 6, wherein the core portion has a core thread disposed on a top face of the fastener tape while the second weld portion is formed on opposing faces between the stopper portion and the core thread.

8. The slide fastener according to claim 6, wherein the core portion has the core thread disposed on the top face of the fastener tape while the second weld portion is formed on opposing faces between the stopper portion and the fastener tape.

9. The slide fastener according to claim 6, wherein the core portion has the core thread disposed on the top face of the fastener tape while the second weld portion is formed respectively on the opposing faces between the stopper portion and the core thread and on the opposing faces between the stopper portion and the fastener tape.

10. The slide fastener according to claim 1, wherein the side edge of the fastener tape has an element fixing yarn while the second weld portion is formed on opposing faces between the stopper portion and the element fixing yarn.

* * * * *